United States Patent [19]

Hirn et al.

[11] Patent Number: 4,995,412

[45] Date of Patent: Feb. 26, 1991

[54] COMBINATION WALKER/CANE/QUAD CANE

[76] Inventors: Doris D. Hirn, 5747 N. Sheridan, Chicago, Ill. 60660-4755; Joyce R. Boin, 1524 Adhland Ave., Park Ridge, Ill. 60068; Susan L. Breakwell, 2240 W. Farwell, Chicago, Ill. 60645

[21] Appl. No.: 404,277

[22] Filed: Sep. 7, 1989

[51] Int. Cl.[5] ..... A61H 3/00

[52] U.S. Cl. ..... 135/67; 135/75; 135/77

[58] Field of Search ..... 135/65, 67, 75, 77

[56] References Cited

U.S. PATENT DOCUMENTS

| | | | |
|---|---|---|---|
| 2,159,301 | 5/1939 | Upton | 135/67 |
| 2,634,790 | 4/1953 | Elle | 135/67 |
| 2,796,916 | 6/1957 | Womble | 135/67 |
| 3,289,685 | 12/1960 | Parker | 135/65 |
| 3,421,529 | 1/1969 | Vestal | 135/67 |
| 3,524,456 | 8/1970 | Dixon | 135/77 |
| 4,044,784 | 8/1977 | Smith | 135/67 |
| 4,085,763 | 4/1978 | Thomas | 135/75 |
| 4,248,250 | 2/1981 | Thomas | 135/67 |
| 4,314,576 | 2/1982 | McGee | 135/67 |
| 4,474,202 | 10/1984 | Blechner | 135/67 |

*Primary Examiner*—David A. Scherbel
*Assistant Examiner*—Lan Mai
*Attorney, Agent, or Firm*—Wallenstein, Wagner & Hattis

[57] ABSTRACT

A walker for aiding the movement of an invalid or other infirm person, comprising a plurality of rigid sections. Each of the sections has two laterally spaced-apart ends. Junction means are provided for removably securing the ends of the rigid sections to each other. Some of the rigid sections are removable from some of the junction means and the walker to form a cane. In addition, the rigid sections are recombinable with the junction means to form a cane. The rigid sections are preferably tubular to provide lightweight strength. These rigid, tubular sections may also include a telescoping portion having a plurality of holes or apertures for adjusting the height of the walker to suit each individual user, and for adjusting the width of the walker.

9 Claims, 2 Drawing Sheets

COMBINATION WALKER/CANE/QUAD CANE

DESCRIPTION

1. Technical Field

This invention relates generally to devices for facilitating the movement of invalids and other persons unable to walk without the assistance of walkers or canes. In particular, the invention relates to a walker which is comprised of a plurality of pieces which can be removed or disassembled. The removed pieces, or some of the disassembled pieces after reassembly, can form either a cane or a portion of a quad cane.

2. Background of the Invention

Invalids or other infirm persons must rely upon conventional walkers, canes, or quad canes to move from place to place. Typical walkers are shown in U.S. Pat. Nos. 4,248,256, issued to Thomas on Feb. 3, 1981; and 4,474,202, issued to Blechner on Oct. 2, 1984. These walkers comprise a plurality of structural components that are held together with bolts, welds, or similar conventional securing means.

A exercise platform for invalids is claimed and described in U.S. Pat. No. 4,314,576, issued to McGee on Feb. 9, 1982. The ends of the tubular elements used to form the rigid structure of this platform are rigidly joined to plastic elbows or tees with ABS plastic cement.

Typical canes and quad canes are disclosed in U.S. Pat. Nos. 3,289,685, issued to Parker on Dec. 6, 1966; and 4,044,784, issued to Smith on Aug. 30, 1977. FIG. 2 of Parker shows a conventional cane, while FIG. 1 shows a quad cane. The difference between these canes is the use in the latter of a separate, four-legged quad cane base piece. One example of such a quad cane base piece is shown in FIG. 5 of Parker. Another example of such a cane piece is shown in FIGS. 3 and 4 of Smith.

Another device for walking assistance is disclosed in U.S. Pat. No. 2,159,301, issued on May 23, 1939, to Upton. This patent describes a crutch or supporting device which can be knocked down into various parts. These parts can then be grouped for transportation.

U.S. Pat. No. 2,796,916, issued to Womble on June 25, 1957, discloses yet another kind of walker. This walker is collapsible or foldable into a compact unit for easy transportation and storage.

Invalids who generally depend on a conventional walker may occasionally find a much less cumbersome cane adequate for their needs. Accordingly, the user must purchase both units.

A large percentage of those requiring walkers are relatively older persons, and frequently retirees. As such, they may have modest financial resources. Thus, the purchase of both a walker and a cane can be burdensome. Moreover, many such persons may depend to some degree on Medicare, Medicaid, or other forms of publicly-available assistance. Such public assistance programs frequently will pay for either a walker or a cane, but not for both.

Accordingly, a need arose for a device which could simultaneously meet the requirements of both cane and walker users.

SUMMARY OF THE INVENTION

The present invention is a walker for aiding the movement of an invalid or other infirm person, comprising a plurality of rigid sections. Each of the sections has two laterally spaced-apart ends.

Junction means are provided for removably securing the ends of the rigid sections to each other. At least some of these rigid sections are removable from the junction means to form a cane. The walker can also be broken down into components. In this case, the component rigid sections and junction means are recombinable to form a conventional cane. Further, a separate quad cane base piece is provided for use with the cane to form a quad cane.

In a preferred embodiment, the rigid sections are tubular to provide lightweight strength. These rigid, tubular sections may also include a plurality of apertures or holes for adjusting the relative length of the rigid sections. Such adjustment permits the walker to be modified to suit the height of each individual user. Such adjustment also permits the walker to be used as an assist at a commode.

Accordingly, it is an object of the invention to provide a walker which can be disassembled to form a conventional cane. It is a further object of this invention to provide a separate quad cane base piece for incorporation into that conventional cane. It is another object of the invention to provide a walker whose effective width can be increased.

DETAILED DESCRIPTION OF THE PREFERRED EMBODIMENT

Referring now to the Figures, a preferred embodiment of the present invention is shown.

Figure 1:
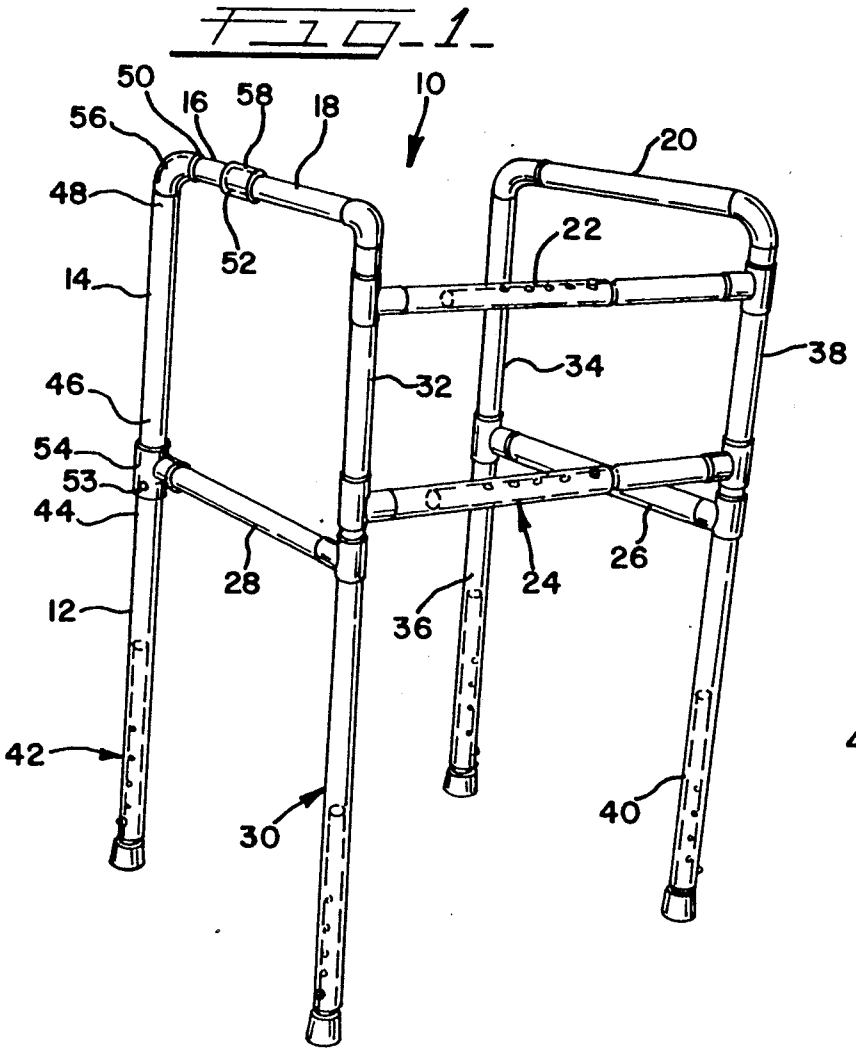
FIG. 1 is a perspective view of a walker in accordance with a preferred embodiment of the invention.

FIG. 1 shows a perspective view of a walker 10 in accordance with this preferred embodiment. The walker 10 acts as an aid to an invalid or other infirm person while walking. The walker 10 includes a plurality of rigid sections. This embodiment includes fifteen such rigid sections, which are identified on FIG. 1 as sections 12, 14, 16, 18, 20, 22, 24, 26, 28, 30, 32, 34, 36, 38, and 40.

Each of the sections has two laterally spaced-apart ends. For example, section 12 has two laterally spaced-apart ends 42 and 44. Sections 14 and 16 each have two laterally spaced-apart ends 46 and 48, and 50 and 52, respectively.

Junction means are provided for removably securing the laterally spaced-apart ends of the rigid sections to each other. In the present embodiment, these junction means comprise tees, 90° elbows, and other similar conventional pipe fittings, including unions. In this embodiment, screws 53 or similar fasteners may be secured through the junction means and the rigid sections to ensure the structural integrity of the walker.

It should be understood, however, that junction means may include any suitable means which both insure structural integrity of the walker and permit some or all of the rigid sections to be broken away from the main structure shown in FIG. 1. It should also be understood that screws 53 may not be necessary when such other junction means are used.

In this FIG. 1, a tee 54 secures lateral end 44 of rigid section 12 to lateral end 46 of rigid section 14. Rigid section 28 is secured to the third opening of tee 54.

The other lateral end 48 of rigid section 14 is secured to a 90° elbow 56. This elbow 56 joins rigid section 14 to the first end 50 of rigid section 16. The other end 52 of rigid section 16 is joined by a straightpipe connector or a union 58 to rigid section 18.

Figure 2:
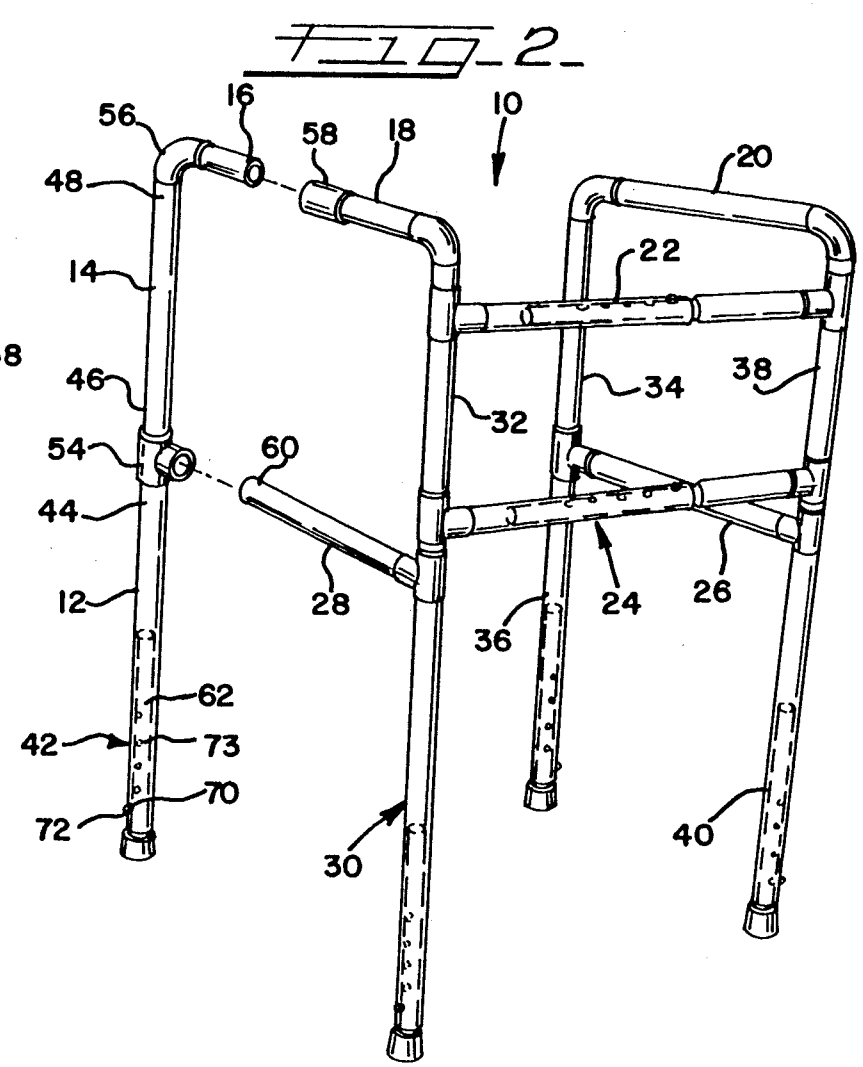
FIG. 2 is a perspective view of the walker of FIG. 1, but with a rigid section of the walker removed from one of its junction means, and combined with other rigid sections and other junction means to form a conventional cane.

As may be seen in FIG. 2, the rigid sections are removable from the junction means. In FIG. 2, lateral end 52 of rigid section 16 is shown as it has been removed from union 58. The lateral end 60 of rigid section 28 has also been removed from tee 54. In this way, rigid sections 12, 14, and 16 are joined with tee 54 and elbow 56. These components together form a conventional cane (FIG. 3).

In addition, it will be understood by those skilled in the art that the rigid sections can be broken apart, to any desired degree, from their respective junction means for ease in transportation of the walker. If the walker is broken apart, then it will be understood by those skilled in the art that rigid sections, such as 12, 14, and 16, are recombinable with junction means, such as 54 and 56, to form the cane of FIG. 3.

Figure 4:
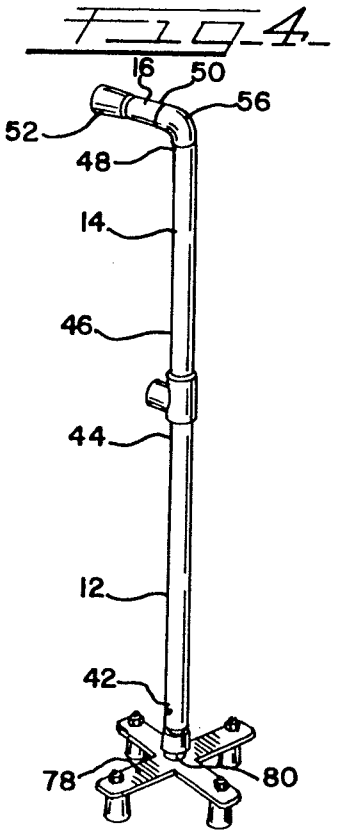
FIG. 4 is a perspective view of the cane of FIG. 3, but with the quad cane base piece in place to form a quad cane.
Figure 3:
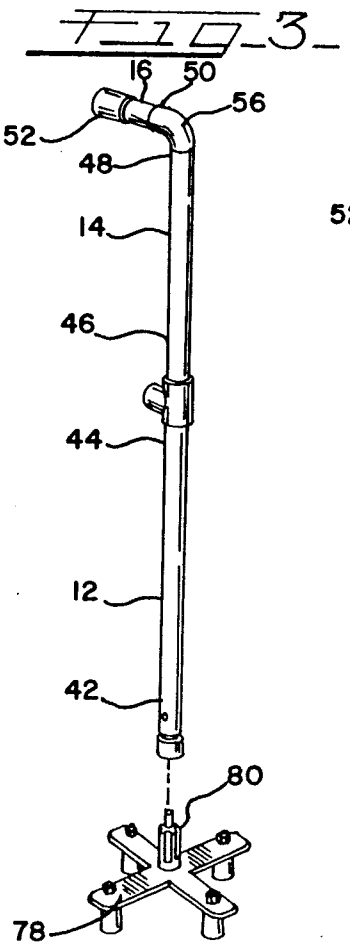
FIG. 3 is a perspective view of the cane of FIG. 2, with a separate quad cane base piece.

The quad cane base piece 78 of FIG. 3 includes a collar 80 which can be inserted into rigid section or leg 12 adjacent its lateral end 42. Collar 80 is preferably made of a hard but compressible polymer or plastic. It is also preferably tapered, and its largest section has a diameter in excess of the inner diameter of rigid section 12. In this way, as it is inserted into the lateral end of rigid section 12, collar 80 compresses against the inner wall of rigid section 12 to form a tight compression-type fit with rigid section 12. The forces on the cane caused by the user's weight further ensure a tight fit. Yet, the quad cane base piece 78 may be easily removed from rigid section 12 by simultaneously twisting and pulling the piece 78 away from the rigid section 12. The finished quad cane, including its base piece 78, is shown in FIG. 4.

Figure 5:
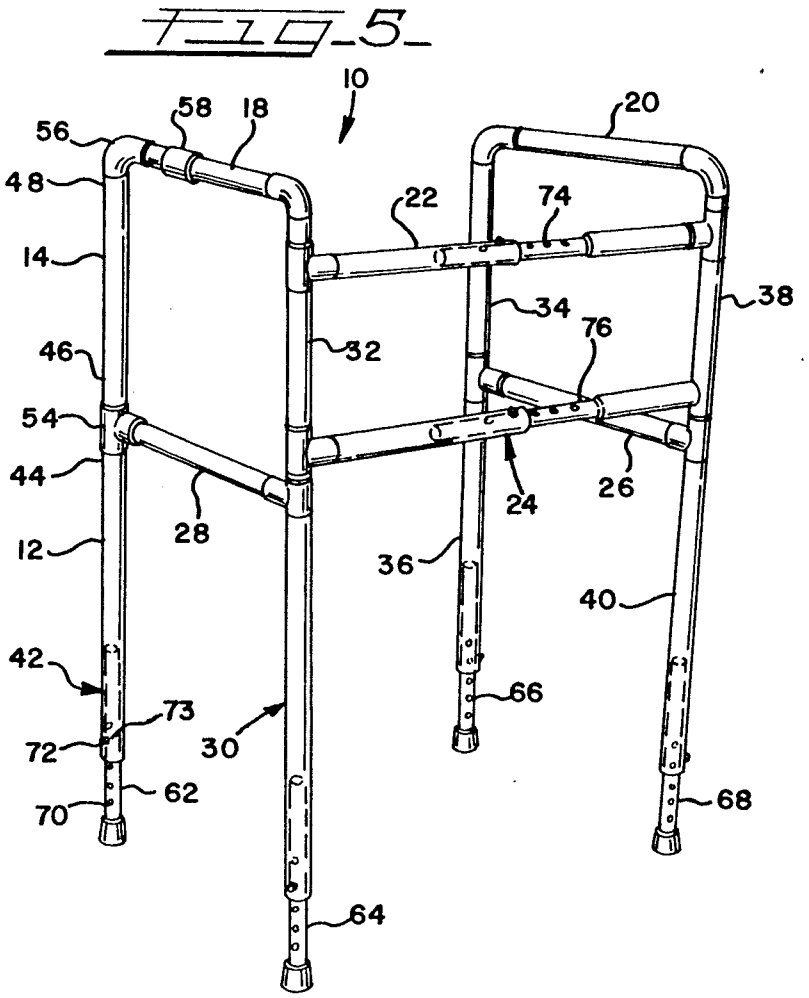
FIG. 5 is a perspective view of the combination walker of the present invention with its adjustable legs raised to accommodate a taller user, and whose width has been effectively increased.

In this preferred embodiment, the rigid sections are tubular to lower the weight of the walker and yet provide strength. To facilitate adjustment and the effective lengthening of these rigid sections, some of them may include the telescoping portions shown in FIG. 5, and in phantom in FIG. 1. For example, each of the rigid sections 12, 30, 36, and 40 in the present embodiment, which serve as legs of the walker 10, include a telescoping portion.

These telescoping portions 62, 64, 66, and 68, respectively, include a plurality of holes or apertures, such as aperture 70. A spring-biased detent or "bullet-tip" catch 72 is provided for each telescoping portion to engage these apertures. For example, by depressing the detent 72, telescoping portion 62 of rigid section 12 may be extended downwardly from the position shown in FIG. 1 to the position shown in FIG. 5. Rigid section 12 is fixed in the position shown in FIG. 5 when the detent 72 is engaged with a new aperture 73. These apertures and detents enable the walker 10 to be suited for individual users of various heights. This aperture-detent arrangement is well-known in the prior art, as shown and described in U.S. Pat. No. 4,044,784. This arrangement is thus not a part of the present invention.

Rigid sections 22 and 24 also include telescoping portions 74 and 76. These portions 74 and 76 permit the widening or enlargement of the walker from its standard conventional width. This widening or enlargement is also facilitated by the aperture-detent arrangement described above. In this widened or enlarged configuration of FIG. 5, walker 10 is of a width sufficient to enable its placement directly over a commode. So placed, the walker 10 acts as an aid, permitting the user's arms to assist in his own lowering to and rising from the commode.

The best mode contemplated for carrying out the invention has been disclosed in this specification. However, the broad claims of the specification, which may not specify details of yet another embodiment, are not limited to embodiments which include only details disclosed in this specification. Furthermore, while specific claimed details constitute important aspects of this invention, the claims of the specification must be construed in light of the doctrine of equivalents.

What we claim is:

1. A walker-forming frame, part of which is convertible into a cane, for aiding the movement of an invalid or other infirm person, comprising:

(a) a right and a left rigid frame section, each of said sections having front and rear vertical leg-forming element means interconnected at their upper end portions by a horizontally extending element means forming a gripping bar for the walker, the front vertical element means of said sections being interconnected by horizontally extending element means and the rear vertical elements being unconnected to form an unobstructed opening into the space between said right and left frame sections, at least one of said vertical element means including a relatively short horizontal portion at the upper end portion thereof, which horizontal portion has a sufficient length to form a readily graspable handle and;

(b) junction means for removably securing said at least one vertical element means to the rest of the frame to form a cane when removed therefrom.

2. The walker-forming frame as set forth in claim 1, wherein said rigid frame sections are tubular elements.

3. The walker-forming frame as set forth in claim 2, including a telescoping portion within at least one of said rigid sections, said telescoping portion having a plurality of holes for adjusting the relative length of said rigid section.

4. The walker-forming frame as set forth in claim 1, wherein each of said vertical element means includes a pair of telescoping portions, one having a plurality of vertically spaced holes and the other a catch for engaging one of said holes for adjusting the relative length of said rigid section.

5. A walker-forming frame, part of which is convertible to a cane, for aiding the movement of an invalid or other infirm person, comprising:

(a) a plurality of horizontally and vertically extending rigid, tubular element means, each of said horizontally extending element means having opposite ends each to be connected to one of said vertically extending element means, each of said vertically extending element means having a bottom ground-engaging end and an upper end portion to be connected to one of said horizontally extending elements, at least one of said vertically extending element means terminating in a short horizontal portion at the upper end portion thereof which horizontal portion has a sufficient length to form a readily graspable handle;

(b) each of said vertically extending element means comprising a pair of telescoping portions, one of which has a plurality of vertically spaced holes for adjusting the relative length of said rigid section and the other having a catch for selectively engaging one of said holes; and (c) junction means for removably securing said at least one vertically extending element means to the rest of the frame so it can form a cane when removed therefrom.

6. The walker-forming frame as set forth in claim 1 or 5, further comprising a quad cane base piece for securing to said cane to form a quad cane.

7. The walker-forming frame of claim 1 or 5 wherein said at least one vertical element means which forms said cane when removed from the frame is one of said rear vertical element means.

8. The walker-forming frame of claim 1 or 7 wherein said junction means includes a junction element removably connected to the end of said short horizontal portion forming said handle.

9. The walker-forming frame of claim 8 wherein said horizontal portion forming said cane handle and said junction means form part of said horizontally extending element means which forms said gripping bar of the walker-forming frame.

* * * * *